US011773596B2

(12) United States Patent
Mitchell

(10) Patent No.: US 11,773,596 B2
(45) Date of Patent: Oct. 3, 2023

(54) ROOF BRACKET AND SYSTEM AND METHODS FOR USING SAME

(71) Applicant: Jim Mitchell, Middleburg, FL (US)

(72) Inventor: Jim Mitchell, Middleburg, FL (US)

( * ) Notice: Subject to any disclaimer, the term of this patent is extended or adjusted under 35 U.S.C. 154(b) by 0 days.

(21) Appl. No.: 17/978,441

(22) Filed: Nov. 1, 2022

(65) Prior Publication Data

US 2023/0052694 A1 Feb. 16, 2023

Related U.S. Application Data

(63) Continuation of application No. 16/671,141, filed on Oct. 31, 2019, now Pat. No. 11,486,145.

(60) Provisional application No. 62/752,658, filed on Oct. 30, 2018.

(51) Int. Cl.

| | |
|---|---|
| ***E04D 13/12*** | (2006.01) |
| ***E04D 15/04*** | (2006.01) |
| ***E04D 13/02*** | (2006.01) |

(52) U.S. Cl.

CPC ..... *E04D 13/02* (2013.01); *E04D 15/04* (2013.01)

(58) Field of Classification Search

CPC ..... E04D 13/12; E04D 15/04

See application file for complete search history.

(56) References Cited

U.S. PATENT DOCUMENTS

| | | | | |
|---|---|---|---|---|
| 1,054,091 | A * | 2/1913 | Darnall | E04D 13/10 52/25 |
| 3,669,051 | A | 6/1972 | Conway | |
| 4,334,662 | A | 6/1982 | Davis et al. | |
| 7,036,629 | B2 | 5/2006 | Nicolaysen | |
| 7,568,671 | B2 | 8/2009 | Lallier | |
| 8,251,326 | B2 | 8/2012 | McPheeters | |
| 8,505,863 | B2 | 8/2013 | McPheeters | |
| 9,057,195 | B2 | 6/2015 | McPheeters | |
| 9,145,685 | B2 | 9/2015 | Stapleton | |
| 9,187,914 | B2 | 11/2015 | Lallier | |
| 9,816,279 | B2 * | 11/2017 | Bond | E04G 3/26 |
| 11,486,145 | B2 * | 11/2022 | Mitchell | E04D 13/12 |
| 2015/0365044 | A1 | 12/2015 | McPheeters | |
| 2020/0263431 | A1 | 8/2020 | Mitchell | |
| 2023/0052694 | A1 * | 2/2023 | Mitchell | E04D 13/12 |

* cited by examiner

*Primary Examiner* — Andrew J Triggs

(74) *Attorney, Agent, or Firm* — BEKIARES ELIEZER LLP

(57) ABSTRACT

Disclosed herein are roof brackets, devices, and apparatuses for standing seam metal roofs to provide a removable place to place a foot. In one aspect, an apparatus may include a bracket configured to releasably secure to a standing seam of a panel, the bracket having a housing having at least one side comprising a slot configured to allow at least a portion of a standing seam to travel therethrough; a plurality of cams contained within the housing, the plurality of cams rotatably connected to the housing at a first portion of the plurality of the cams; at least one elongated member connected to at least one of the plurality of cams; and at least one tension element connected to the housing and in operable communication with at least one of the plurality of cams. Also disclosed herein are methods for using the disclosed roof brackets and apparatuses.

20 Claims, 15 Drawing Sheets

900

ROOF BRACKET AND SYSTEM AND METHODS FOR USING SAME

RELATED APPLICATIONS

This application is a continuation of U.S. application Ser. No. 16/671,141 filed on Oct. 31, 2021, which issues on Nov. 1, 2022 as U.S. Pat. No. 11,486,145, which claims priority to U.S. Provisional Application No. 62/752,658 filed on Oct. 30, 2018, which are hereby incorporated by reference herein in its entirety.

It is intended that the above-referenced application may be applicable to the concepts and embodiments disclosed herein, even if such concepts and embodiments are disclosed in the referenced applications with different limitations and configurations and described using different examples and terminology.

FIELD OF DISCLOSURE

The present disclosure relates to one or more of the following Cooperative Patent Classifications: B62D27/00 Connections between superstructure or understructure sub-units (B62D33/0207, B62D33/044 take precedence; between sub-units predominantly made of synthetic material B62D29/048); F16B21/00 Means for preventing relative axial movement of a pin, spigot, shaft or the like and a member surrounding it (riveted or deformable spigots F16B19/04; for gudgeon pins F16J1/18); Stud-and-socket releasable fastenings; F16B11/00 Connecting constructional elements or machine parts by sticking or pressing them together, e.g. cold pressure welding (non-electric welding in general B23K; methods of using adhesives independently of the form of the surfaces joined C09J5/00); F16B DEVICES FOR FASTENING OR SECURING CONSTRUCTIONAL ELEMENTS OR MACHINE PARTS TOGETHER, e.g. NAILS, BOLTS, CIRCLIPS, CLAMPS, CLIPS, WEDGES, JOINTS OR JOINTING (couplings for transmitting rotation F16D); E04D13/00 Special arrangements or devices in connection with roof coverings.

BACKGROUND OF THE DISCLOSURE

In some situations, when roofers are working on a roof, they may not have the proper safety equipment to prevent them from sliding off of a roof. Thus, the conventional strategy is to nail wooden beams or planks onto a roof for footholds. Another conventional method would be to use cranes and ladders to provide sufficient elevation to work on roofs. This often causes problems because the conventional strategy does not address challenges that arise when working on metal roofs. For example, a standing seam metal roof. Also, the cost of cranes, special ladders, and extra manpower can be extremely expensive and cost prohibitive for smaller roofing projects.

Accordingly, there remains a need for a secure removable device for the placement of your foot while working on a standing seam metal roof without sliding. This need and other needs are satisfied by the various aspects of the present disclosure.

SUMMARY OF THE DISCLOSURE

In accordance with the purposes of the disclosure, as embodied and broadly described herein, the disclosure, in one aspect, relates to a specialized roof bracket and system for use in connection with a standing seam metal roof, which can solve the problem of allowing you to have a place to put your foot while working on a standing seam metal roof without sliding. For example, the present disclosure may be referred to herein as a device, system, bracket, shoe plate, platform, roof sliding prevention apparatus, roof sliding prevention system, or apparatus may be also described or referred to as a product, apparatus, or device named The ROOFRAT™ Bracket, or other such designation determined by the applicant. In further aspects, the disclosure provides methods for using the disclosed roof brackets, devices and systems, for example, to provide a secure foot location to step on when working on a standing seam metal roof.

In another exemplary aspect, the disclosure relates to a removable roof platform wherein a roofer may place their footed shoe in said roof platform. In response to a placing the weight of a footed shoe on the roof platform, the roof platform can engage and secure to a standing seam, whereby the roof platform can be activated to provide stationary support on the roof by securing tightly to the standing seam. In further aspects, the disclosed roof brackets and platforms can be left in place and slid upslope on a standing seam without disengaging and without the use of tools to secure and/or move positions along a standing seam.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate several aspects of the disclosure and together with the description, serve to explain the principles of the disclosure.

DETAILED DESCRIPTION OF THE DISCLOSURE

Figure 1:
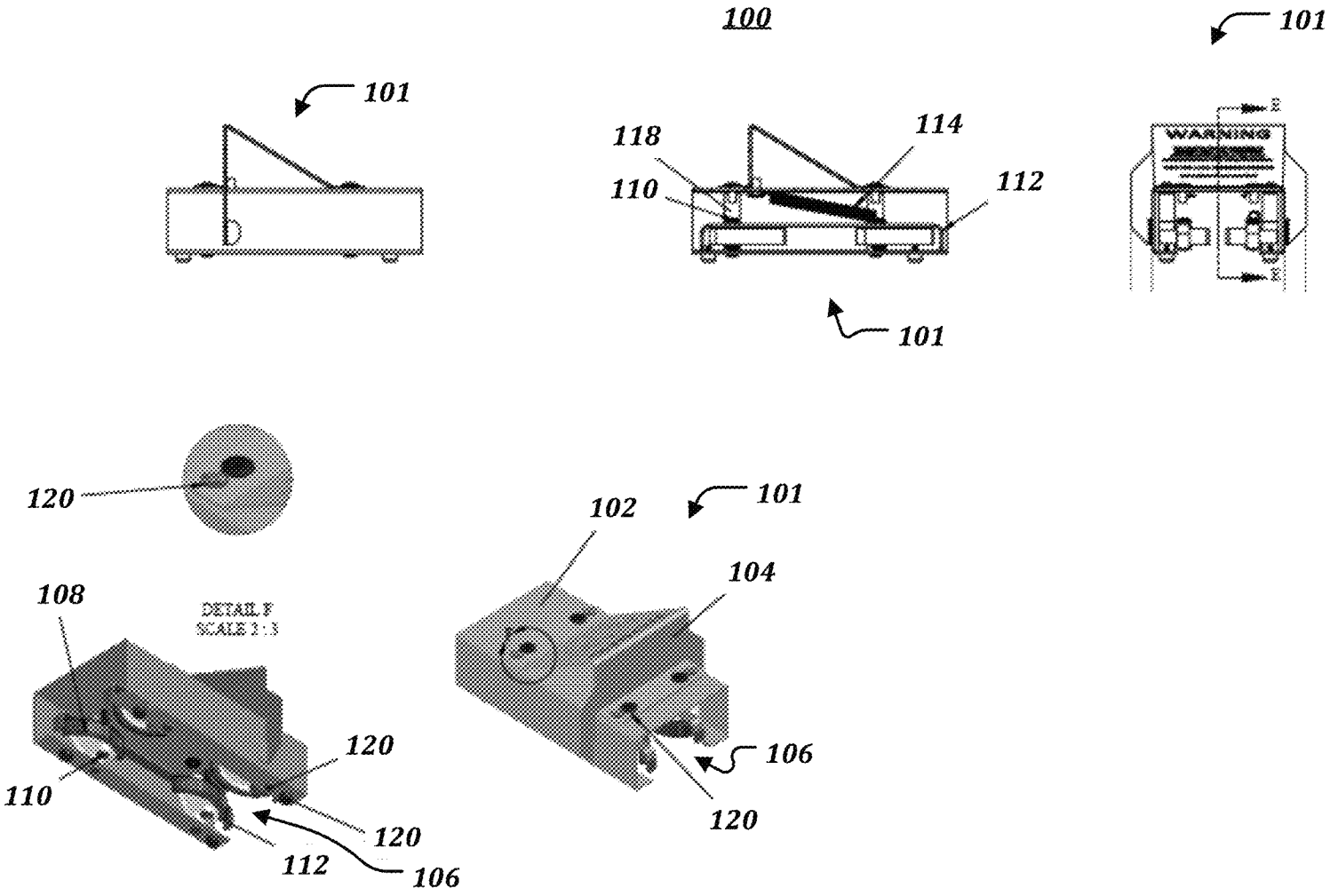
FIG. 1 shows a depiction of various views of a specialized roof bracket and shoe plate for roof sliding prevention in accordance with an exemplary embodiment of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of a device, apparatus, or roof bracket for roof sliding prevention, embodiments of the present disclosure are not limited to use only in this context.

The present disclosure can be understood more readily by reference to the following detailed description of the disclosure and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the disclosure. Thus, if there are a variety of additional steps that can be performed it is understood that each of these additional steps can be performed with any specific aspect or combination of aspects of the methods of the disclosure.

The present disclosure may be referred to herein as a device, system, bracket, shoe plate, safety means, roof sliding prevention apparatus, roof sliding prevention system, and method for roof sliding prevention may also be described or referred to as a product, apparatus, system, means, or device named The ROOFRAT™ Bracket, or other such designation determined by the applicant.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Roof Bracket, Apparatus and System Overview

Consistent with embodiments of the present disclosure, a roof bracket for foot sliding prevention, and roof apparatuses and systems comprising the same may be provided. This overview is provided to introduce a selection of concepts in a simplified form that are further described below. This overview is not intended to identify key features or essential features of the claimed subject matter. Nor is this overview intended to be used to limit the claimed subject matter's scope. The roof bracket, apparatus and system for roof sliding prevention may be used by individuals or companies in connection with a standing seam metal roof, for example, to provide a secure, removable stationary platform for the placement of a foot while working on the roof.

The present disclosure may be referred to herein as a roof bracket, apparatus, device, system, roof platform, stationary roof apparatus, removable roof platform system, and method for providing a stationary roof platform may also be described or referred to as a product, apparatus, system, means, or device.

In another exemplary aspect, the disclosure may provide a removable roof foot platform wherein a roofer may place their footed shoe in said roof platform. In response to a placing the weight of a footed shoe on the platform, in the safety means, the platform can engage and secure to standing seam, whereby the platform can activate to provide stationary support on the roof by securing tightly to the standing seam. In further aspects, the disclosed roof brackets, platforms, and systems can be left in place and slid upslope on a standing seam without disengaging and without the use of tools to secure and/or move positions along a standing seam. In various aspects, the disclosed roof brackets, apparatuses, devices, systems, and platforms are not fall protection products, but rather a secure surface to place a weighted object such as a foot. According to various further aspects, when embodiments of the present invention are being using on a standing seam of a metal roof, users should be tied off according to current OSHA fall protection requirements and/or any other applicable statute based on the duties being performed on the roof.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

Roof Bracket, Apparatus and System Configuration

As briefly described above, the present disclosure relates, in various aspects, to roof brackets, platforms, and systems for roof sliding prevention. In one aspect, the present disclosure provides a specialized roof bracket for roof sliding prevention.

In further aspects, the disclosed devices, systems and apparatuses are useful for providing secure, removable stationary platform, which may help in roof sliding prevention. In still further aspects, the device can be useful for providing a place to put your foot on a standing seam metal roof without sliding. In even further aspects, there may be additional uses of the apparatus including gripping other standing seam surfaces.

According to various aspects of the present disclosure, a roof bracket of the present invention comprises a housing, which may be shaped to conform to the contour of a standing surface, such as, for example, a standing seam of a metal roof. In further aspects, the shaped housing may have an established shape, for example, by a preformed housing, or may be a moldable or foldable housing that is shaped by a user. The housing may contain one or more components or elements described herein associated with the roof bracket.

In further aspects, a housing may be flat in shape on at least its proximal side (i.e., bottom) so that the contact area is shaped so that substantially all of the proximal side of the housing contacts the surface adjacent to the standing seam. All or a portion of a housing may be flat. Additionally, a proximal side and/or a distal side of the casing may be flat or planar, and the lateral sides of the casing may be shaped. In still further aspects, the lateral sides of the housing may be shaped in any form desired. The housing can be any shape, and preferably is in the shape of a three-dimensional polygon and the housing walls define an interior space or interior sections for containing the operating elements of the invention. Any other shape (as used herein, the term shape is used in the broad sense of three-dimensional works) may be employed, so long as the shape is large enough and structured so as to be able to contain the various working components of the invention as more fully disclosed below.

In further aspects, the housing is a generally hollow structure sized to contain the components and a standing seam disposed therein. The housing can be a rigid hollow shell or open container having an interior volume. Such housings and containers are known, as well as their materials and methods of construction are within the skill of those in the art. The housing may be constructed such that housing can contain and hold the cams and components in a predetermined position relative to the standing seam when the standing seam is inserted through a slot or channel of the housing. In still further aspects, the housing may comprise a metal housing. The metal housing may be planar plate that is molded or folded into a c-shaped bracket allowing for ease of inserting and gripping the standing seam. In another aspect, the present disclosure provides for a roof bracket comprising cams configured to grip standing seams. In another aspect, the present disclosure provides a metal housing such that the housing houses the cams. In further aspects, the housing may comprise at least one cam pocket for containing the cams. The cam pocket may comprise a channel or other type of compartment in the housing into which a cam, gripping element, or locking mechanism can be placed. As shown in the Figures, the cam pocket is accessed in the standing seam slot via a mouth or an opening in the housing. Alternatively, the cam pocket can be located at other sites on the housing depending on the size and shape of housing and the location of the cams and tension elements within the housing. In further aspects, the housing comprises at least one aperture for receiving a fastener, or connecting or attachment means. In still further aspects, the housing can comprise a plurality of apertures for receiving fasteners and/or a connecting or attachment means. In yet further aspects, the housing can comprise at least one aperture for receiving a fastener, or connecting or attachment means for connecting to a portion of one or more of the plurality of cams. In even further aspects, the housing can comprise at least one aperture for receiving a fastener, or connecting or attachment means for connecting to a plate, such as a shoe plate, or other component configured for placement of a weighted object, such as footed shoe.

In further aspects, the housing and/or shoe plate may further comprise a gripping area comprising an anti-slip material, for example, high friction rubber, on a portion or substantially all of the outer surface of the housing and/or shoe plate. In still further aspects, a gripping area may be found on the proximal (or bottom side) of the housing and may cover a portion or substantially all of an area on the proximal side that corresponds to the surface adjacent to the standing seam. In yet further aspects, housing may further comprise a gripping area on a portion or substantially all of the distal (i.e., top) and lateral (i.e., side) sides of the housing. In even further aspects, the gripping area may comprise gripping feet or the like.

In further aspects, the cams may be positioned within the housing such that when a standing seam is inserted into the seam slot in a first direction, the cams give slightly. Subsequently when weight or pressure is applied to the housing in an opposing direction, the cams rotate about a pin to securely grip the standing seam.

As described herein, the cams may be positioned or configured to have a predetermined angle and/or depth (e.g., depth with the seam slot) effective to consistently provide for effective positioning and secure gripping of the standing seam. In further aspects, the bracket can remain in place once position on the standing seam, and can be repositioned by sliding the bracket upslope on the standing seam without disengaging. Further, tools are not required to move the bracket or secure the bracket to the seam. To this end, a user can simply step on the bracket again and it will engage automatically with the weight applied, and thus, securely grip the standing seam. Additionally, the width of the housing channel and the internal seam slot are configured such to provide controlled movement of the standing seam in a manner that allows for safe positioning of the standing seam in the slot channel while providing for effective and secure gripping of the seam upon applying pressure to the housing, such as when stepping on the housing or shoe plate. In further aspects, the angle, position, and pressure applied to the standing seam allows the bracket to be adapted from safely passing the standing seam through the apparatus and providing for effective and secure gripping of the standing seams by the cams housed in the bracket.

In further aspects, also disclosed herein is a platform system comprising a plurality of disclosed roof brackets. In still further aspects, one or more of the plurality of roof brackets can be detachable connected with one or more different rook brackets, for usable using an elongated member or plate. To this end, connected roof brackets can be secured to adjacent standing seams and the elongated member connecting the roof brackets can provide a stationary platform, which can extend from one standing seam to one or more standing seams. In even further aspects, a plurality of roof brackets can be secured to a plurality of standing seams, and then a plurality of elongated members can be connected to the plurality of roof brackets to provide a stationary platform extending across multiple standing seams, for example, across 2, 3, 4, 5, 6, or more standing seams.

According to various further aspects of the disclosure, the inventive roof bracket, apparatuses, platforms, devices and systems can comprise multiple configurations. For example, various exemplary embodiments of the inventive brackets, devices and systems are shown in FIGS. 1-14.

In various aspects, FIGS. 1-13 show various views and features of an exemplary device for the specialized roof bracket and shoe plate for securing to a standing seam, or roof sliding prevention apparatus in accordance with the present disclosure. In these embodiments, the specialized roof bracket and shoe plate comprises a bracket, one or more cams, one or more housings, one or more connecting means, one or more rubber overmold components fitting the one or more cams, one or more footings, at least one tension elements, one or more fasteners including but not limited to nuts, bolts, screws, washers, a label, and a foothold component. The one or more connecting means can include any suitable fastener. Example suitable fasteners can include rivets, bolts, nuts, screws, standoffs, posts, or any suitable fastener. Connecting means can also use attaching or attachment means. Generally, as used herein, attachment means can include glues, adhesives, elastomers, straps, or other attachment devices/methods.

FIG. 1 shows a depiction of various views of a roof bracket in accordance with an exemplary embodiment of the present disclosure. FIG. 1, 100 shows an overview of the roof bracket and plate for securing to a standing seam of a metal roof. Multiple views and components shown in FIG. 1 are described in detail in subsequent figures.

As illustrated, a roof bracket 101 is an apparatus for securing to a standing seam of a panel or roof. A standing seam may be mechanical in nature, allowing for a relatively robust seam that is leveraged by exemplary embodiments to allow to for technical effects and benefits including increased operator safety, increased operator efficiency, a reduction in waste as compared to traditional scaffolding/crossbars, and other similar effects and benefits.

The roof bracket 101 may include a bracket 102 and housing 104 disposed on the bracket 102. The bracket 103 is configured to releasably secure to the standing seam of the panel. Generally, the bracket 102 includes a housing having at least one side comprising a slot 106 configured to allow at least a portion of a standing seam to travel therethrough.

The roof bracket 101 may also include a plurality of cams 108 contained within the housing. The plurality of cams 108 are rotatably connected to the housing at a first portion 110 of the plurality of the cams 108.

The roof bracket 101 also includes at least one elongated member 112 connected to at least one of the plurality of cams 108. The elongated member 112 interconnects cams 108.

The roof racket 101 also includes at least one tension element 114 connected to the housing and in operable communication with at least one of the plurality of cams 108. The at least one tension element 114 can be configured to exert a force effective to maintain at least said cam at a first cam position. The force may be exerted by a spring, elastomer, or other tension element.

As further illustrated, the roof racket 101 may further include a plurality of fasteners 120. Generally, fasteners 120 may include rivets, bolts, nuts, screws, standoffs, posts, or any suitable fastener.

Figure 2:
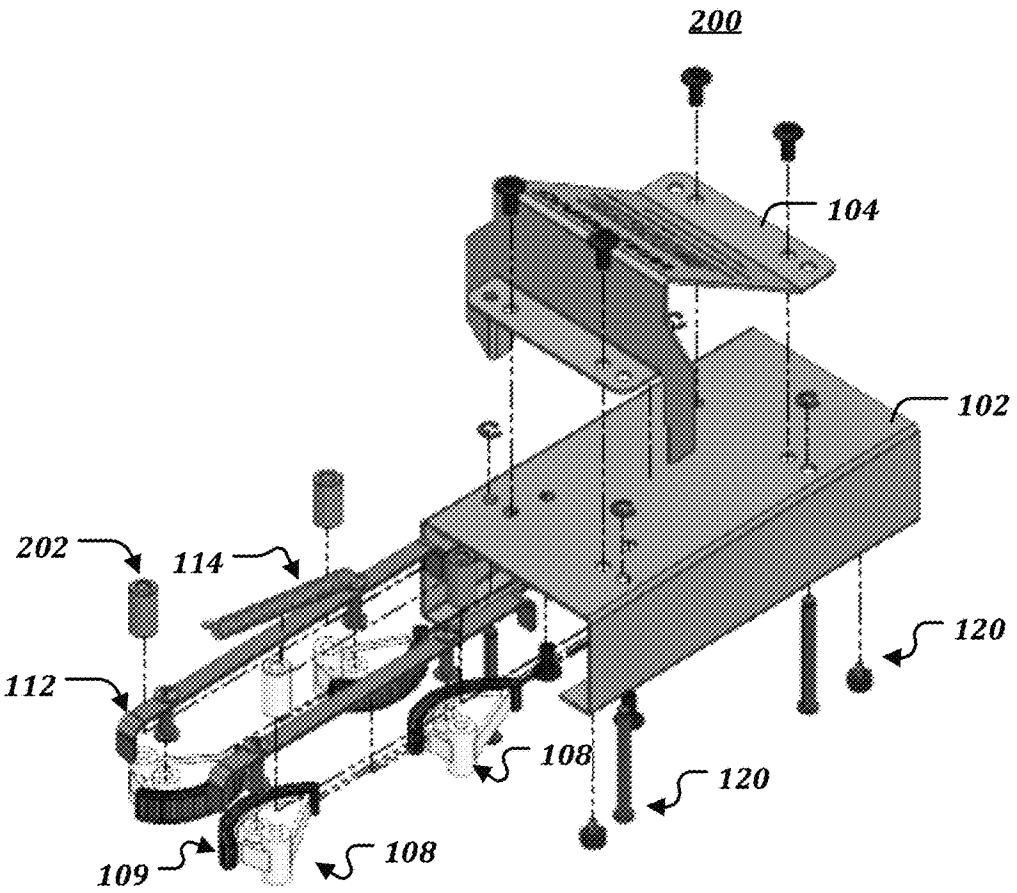
FIG. 2 shows a depiction of an exploded view of a specialized roof bracket and shoe plate for roof sliding prevention in accordance with an exemplary embodiment of the present disclosure.

FIG. 2 shows a depiction of an exploded view of a roof bracket 101 in accordance with an exemplary embodiment of the present disclosure. FIG. 2, 200 shows an overview of the roof apparatus including a roof bracket comprising a housing 102/104, a plurality of cams 108, rubber overmold components 109 fitting the cams 108, one or more footings, at least one spring or tension element 114, one or more fasteners 120 including but not limited to nuts, bolts, screws, washers, a warning label, and a foothold component 104. As further shown, cam spacer components 202 may be used to define an axis about which each cam 108 may rotate.

Figure 3:
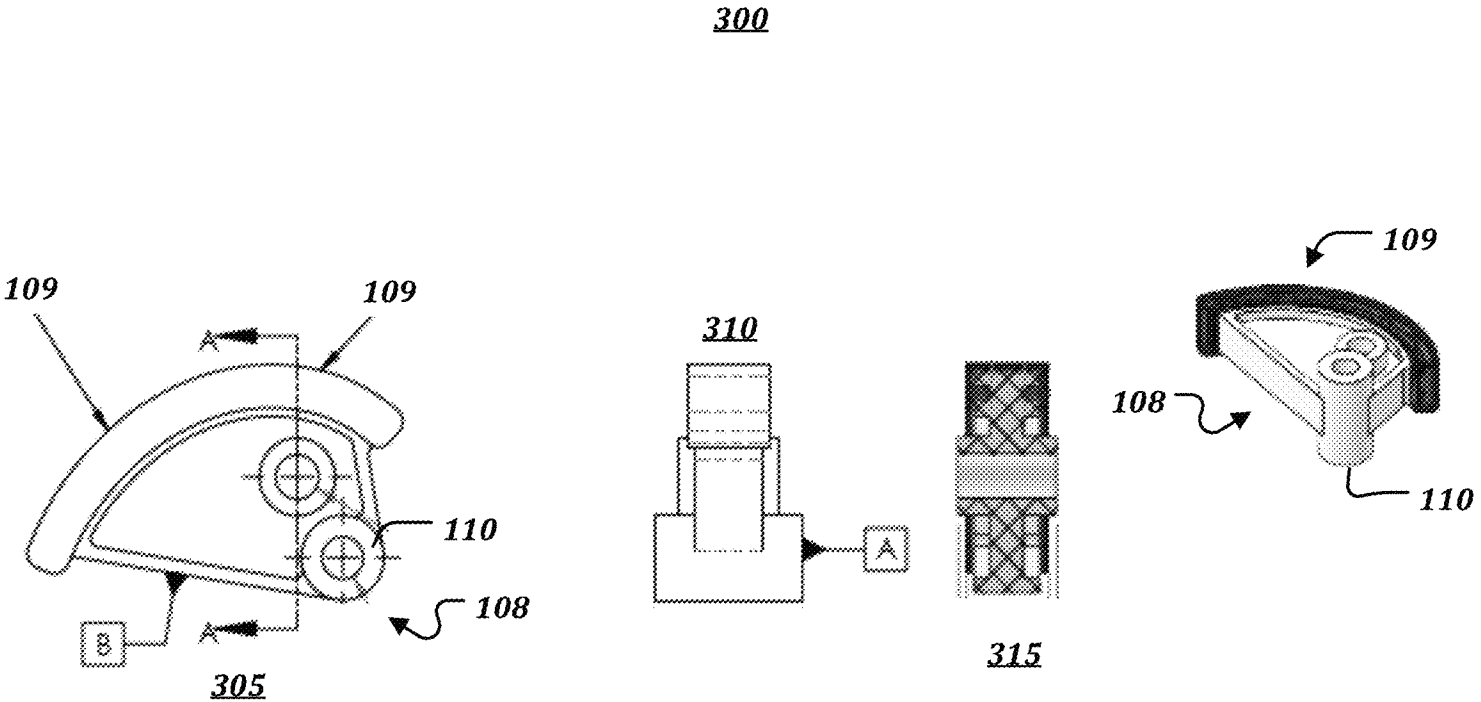
FIG. 3 shows a depiction of a component view of a roof bracket for roof sliding prevention in accordance with an exemplary embodiment of the present disclosure.
Figure 4:
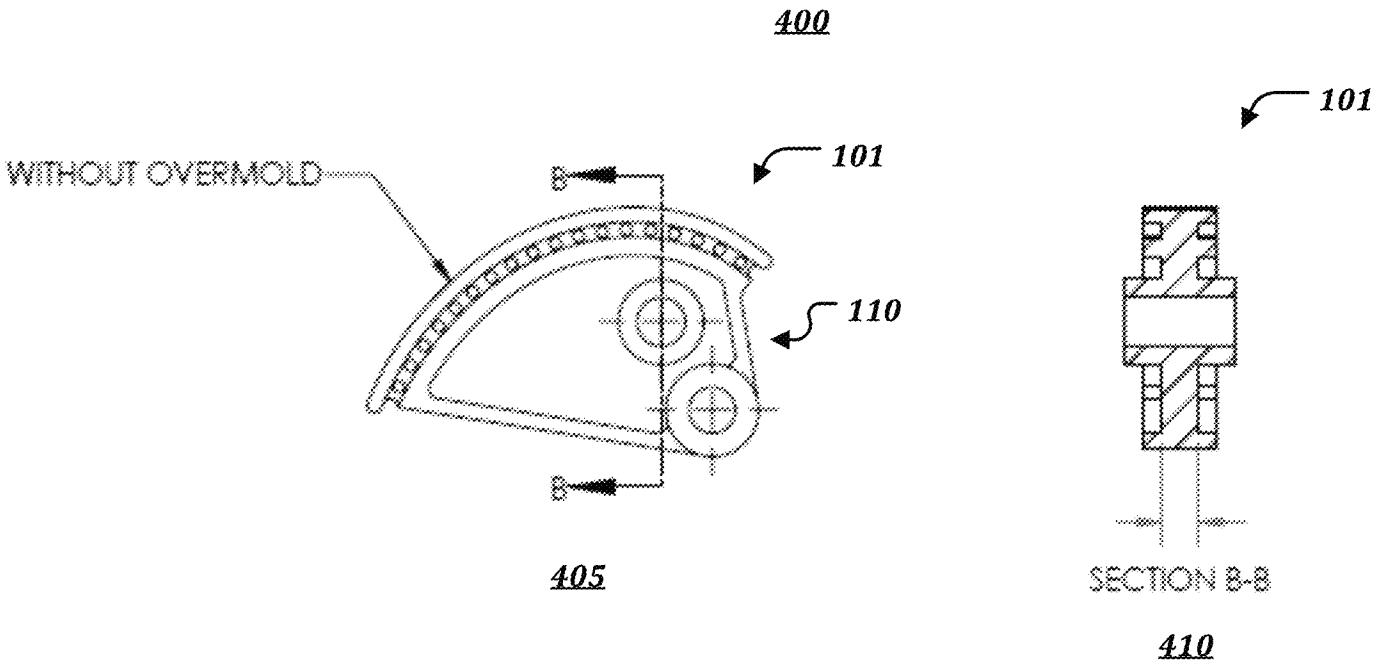
FIG. 4 shows a depiction of a component view of a roof bracket for roof sliding prevention in accordance with an exemplary embodiment of the present disclosure.

FIGS. 3-4 show depictions of a cam component view of a specialized roof bracket in accordance with an exemplary embodiment of the present disclosure. FIG. 3, 300 shows an overview of an exemplary cam component 108 used in an embodiment of the specialized roof bracket. FIG. 3, 305 shows a side view of the cam component of the specialized roof bracket and shoe plate for roof sliding prevention. FIGS. 3, 310 and 315 show a cross sectional view of the cam component of the specialized roof bracket. FIG. 3, 320 shows an isometric view of the cam component of the specialized roof bracket.

As shown, the cam can comprise a plurality of apertures 110 for receiving a connecting or attachment means. For example, the cam may comprise a first aperture for receiving a connecting or attachment means for connecting to a portion of the housing, and a second aperture for receiving a connecting or attachment means for connecting to a portion of the elongated member. Generally, the cam is configured to rotate about an aperture. For example, an aperture 110 can define an axis of rotation of the cam 108. In further aspects, the cam can comprise a gripping edge 109 (e.g., rubber overmold or the like) configured to secure against the standing seam. Thus, at least one cam position is configured to cause an effective portion of the gripping edge 109 of the cam 108 to secure against a portion of the standing seam to prevent movement within the housing 102/104.

As shown, the cam 108 can be shaped and sized wherein at least a portion of the at least one cam in a first cam position is configured to extend into the seam slot in a first predetermined distance to allow the seam to move within or otherwise be positioned within the seam slot. When an effective amount of opposed pressure is exerted against the bracket containing the cam, the cam can rotate about the axis to a second cam position such that a different portion of the cam extend into the slot in a second predetermined distance, greater than the first predetermined distance to thereby secure the standing seam in place.

FIG. 4, 400 shows an overview of the cam component of the specialized roof bracket without a gripping portion. FIGS. 4, 405 and 410 show a cross sectional view of the cam component of the specialized roof bracket and shoe plate for roof sliding prevention.

Figure 5:
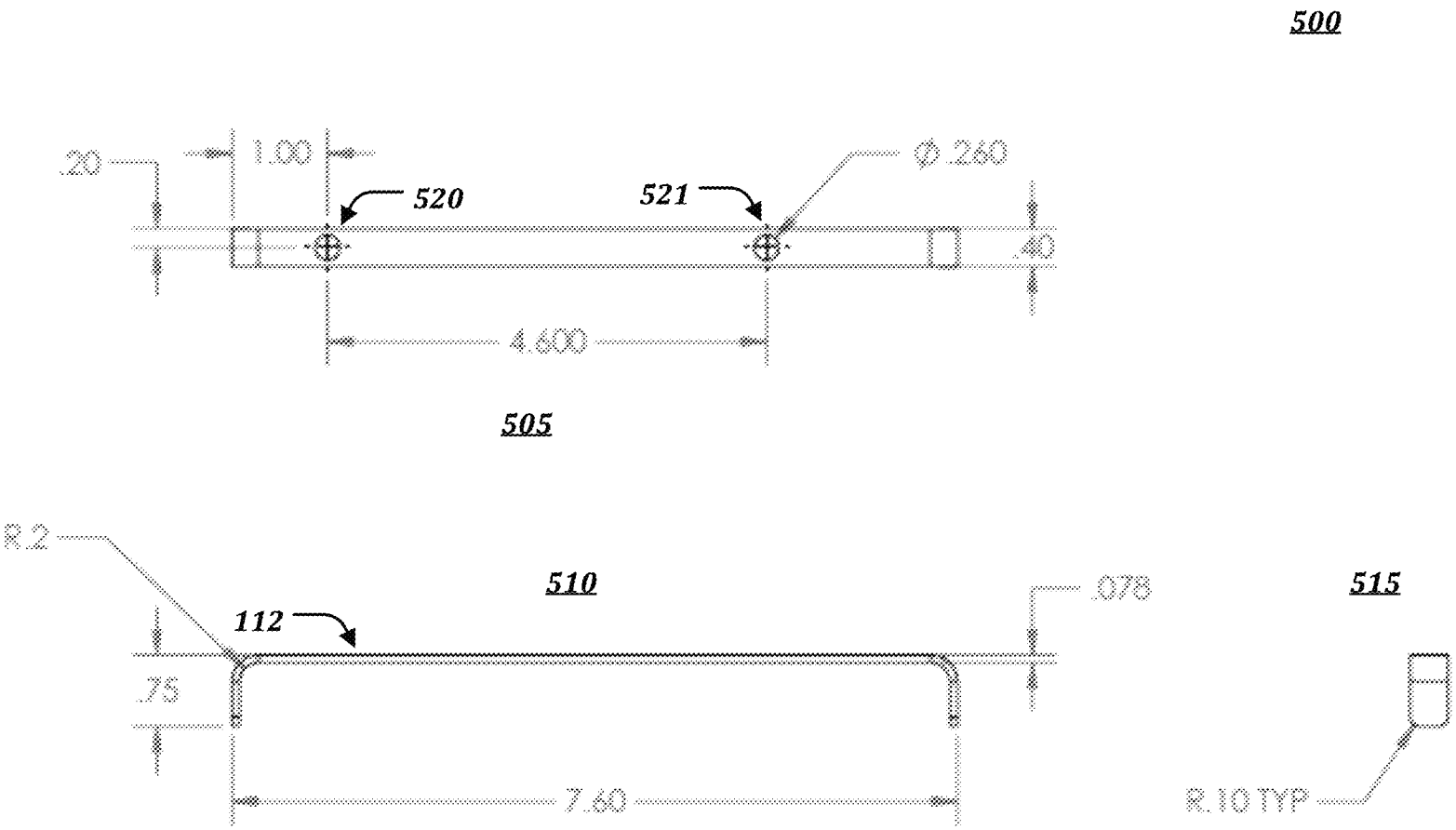
FIG. 5 shows a depiction of a component view of a roof bracket for roof sliding prevention in accordance with an exemplary embodiment of the present disclosure.

FIG. 5 shows a depiction of an elongated member 112 used in the specialized roof bracket and shoe plate for roof sliding prevention in accordance with an exemplary embodiment of the present disclosure. FIGS. 5, 505, 510 and 515 show various views of the elongated member 112. The elongated member 112 can be used to connect multiple cams 108 with a group of the plurality of cams, such as all cams within each cam pocket is connected using an elongated member 112. For example, a first group of the plurality of cams is connected using a first elongated member, and a second group of the plurality of cams is connected using a second elongated member.

To this end, the elongated member can comprise a plurality of apertures 520, 521 for receiving a connecting or attachment means, such as to connect to multiple cams. For example, the elongated member 112 may comprise a first aperture 520 for receiving a connecting or attachment means for connecting to a portion of a first cam, and a second aperture 521 for receiving a connecting or attachment means for connecting to a portion of a second cam. The elongated member 112 can be configured to control movement of any cam connected thereto. In some aspects, the elongated member 112 may be configured to control movement of any cam connected thereto by pulling a first end in a first direction or pushing a second opposed end in the first direction. In other aspects, the elongated member can be configured to control movement of any cam connected thereto by pulling a second member end in a second direction or pushing first member end in the second direction. The elongated member may be controlled using handle portion 515 or the like.

Figure 6:
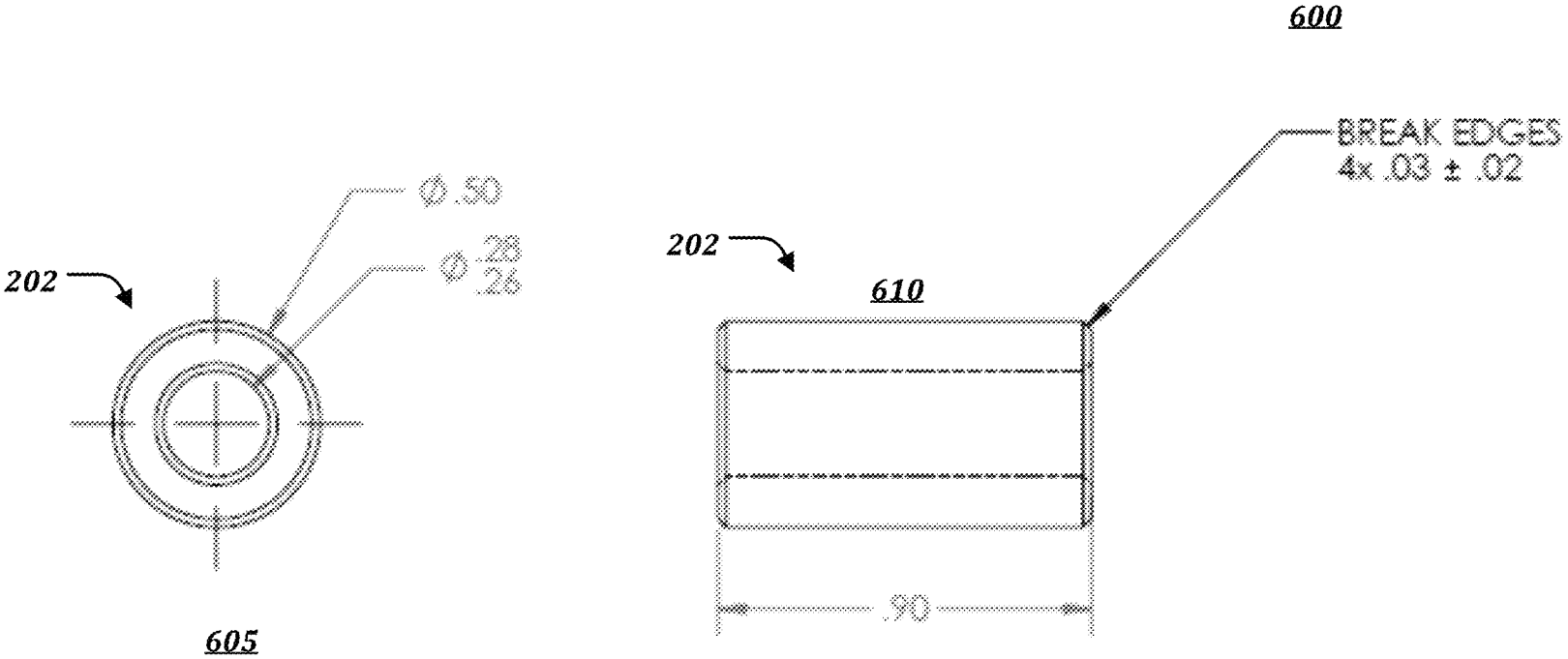
FIG. 6 shows a depiction of a component view of a roof bracket for roof sliding prevention in accordance with an exemplary embodiment of the present disclosure.

FIG. 6, 600, 605, 610 shows a depiction of a cam spacer component 202 view of a specialized roof bracket and shoe plate for roof sliding prevention in accordance with an exemplary embodiment of the present disclosure.

Figure 7:
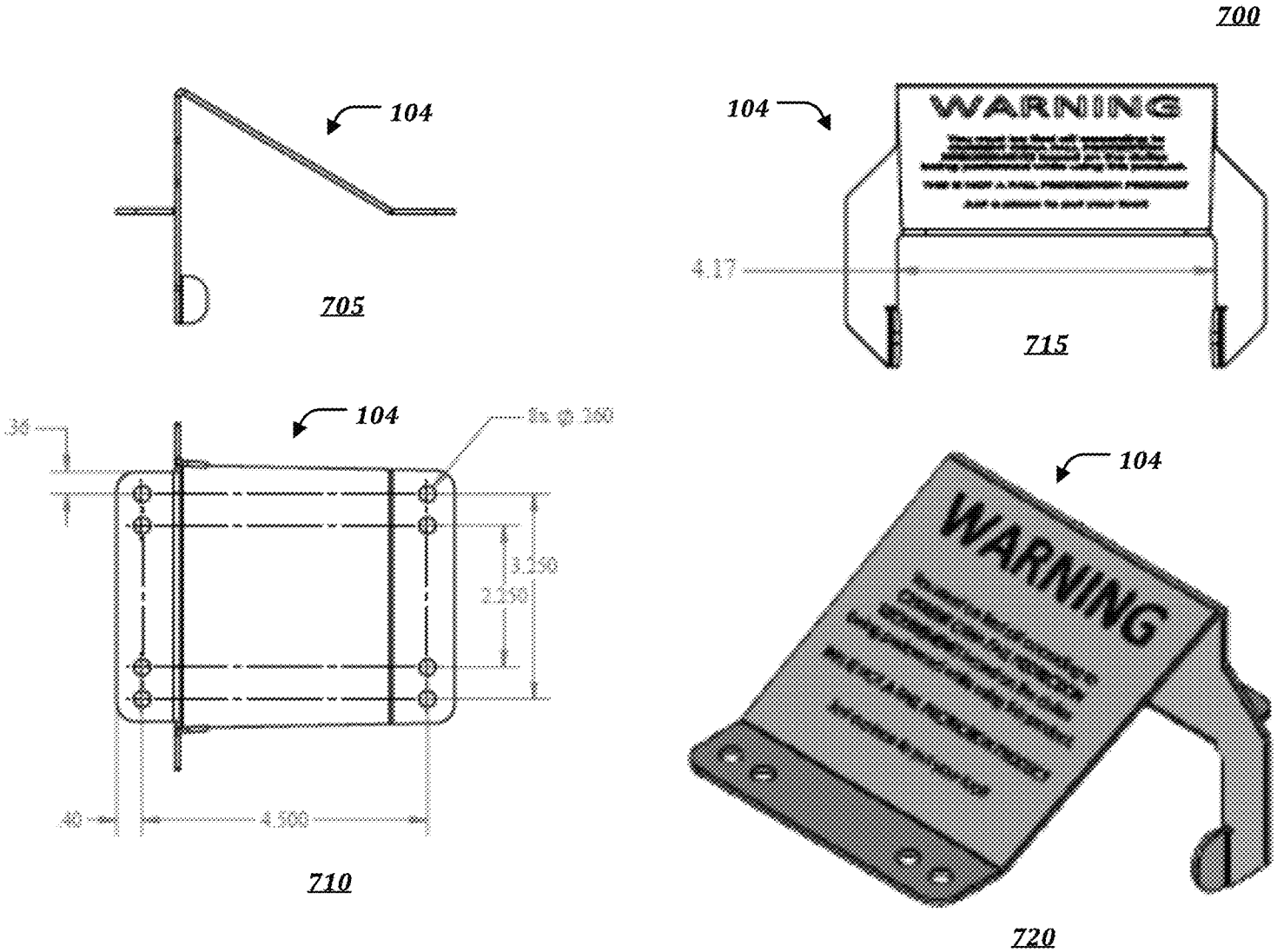
FIG. 7 shows a depiction of a component view of a roof bracket for roof sliding prevention in accordance with an exemplary embodiment of the present disclosure.
Figure 8A:
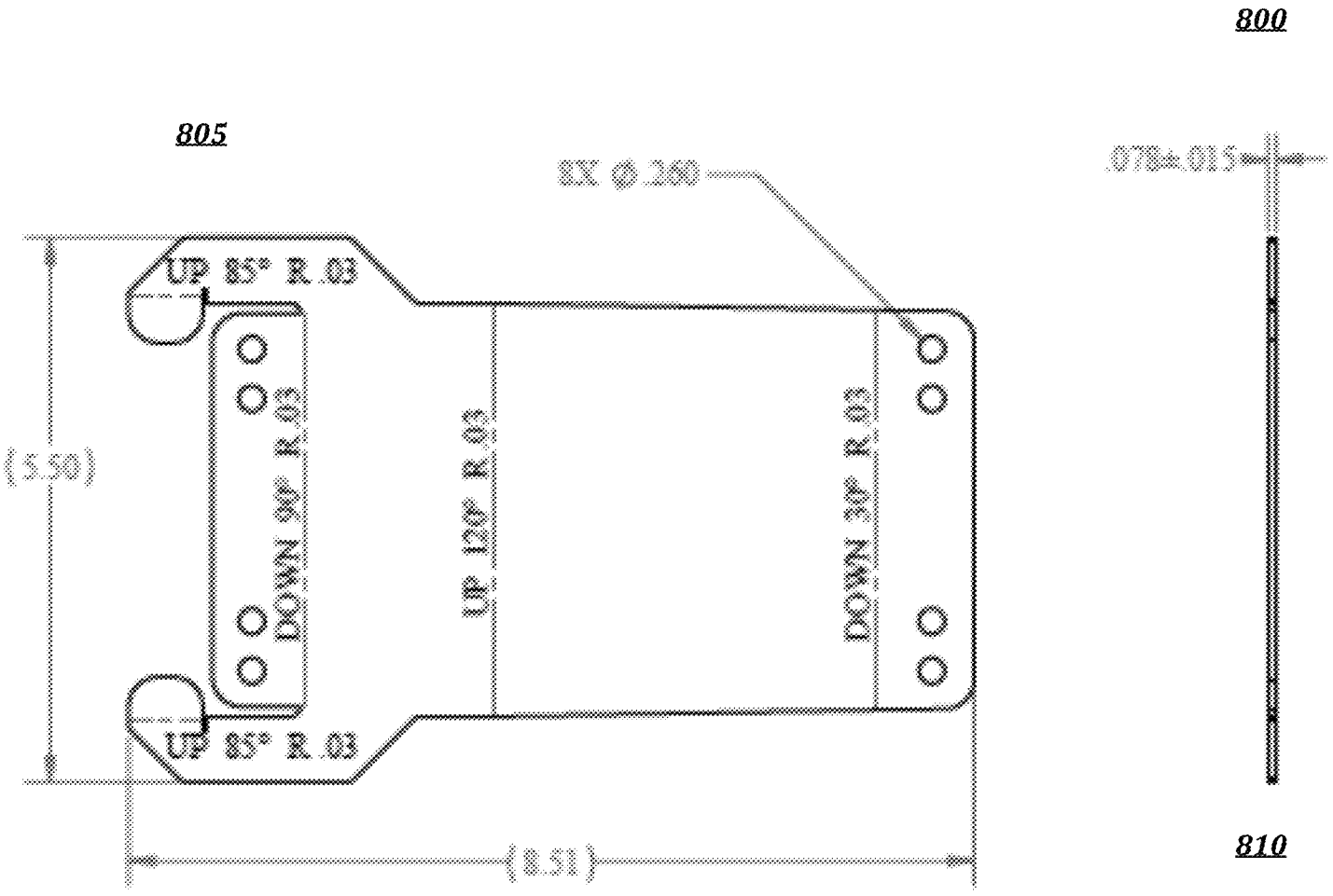
FIGS. 8A and 8B show a depiction of a component view of a roof bracket for roof sliding prevention in accordance with an exemplary embodiment of the present disclosure.
Figure 8B:
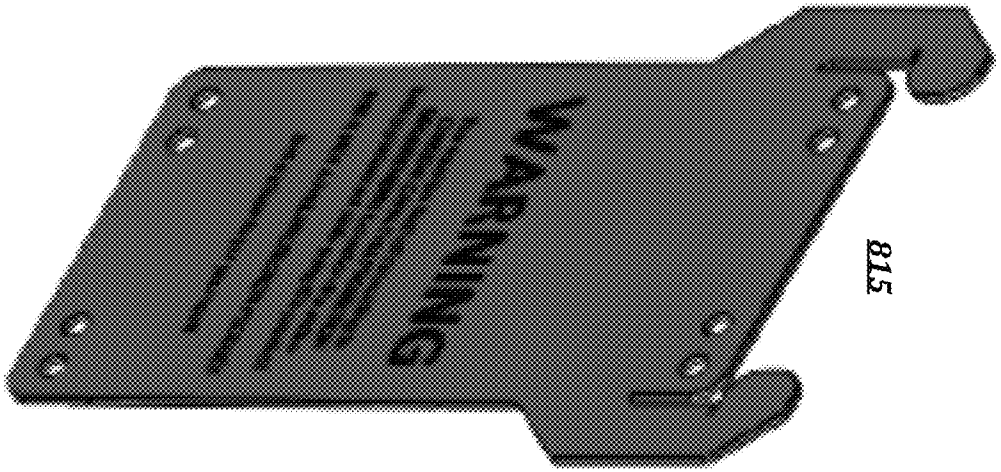
Figure 9:
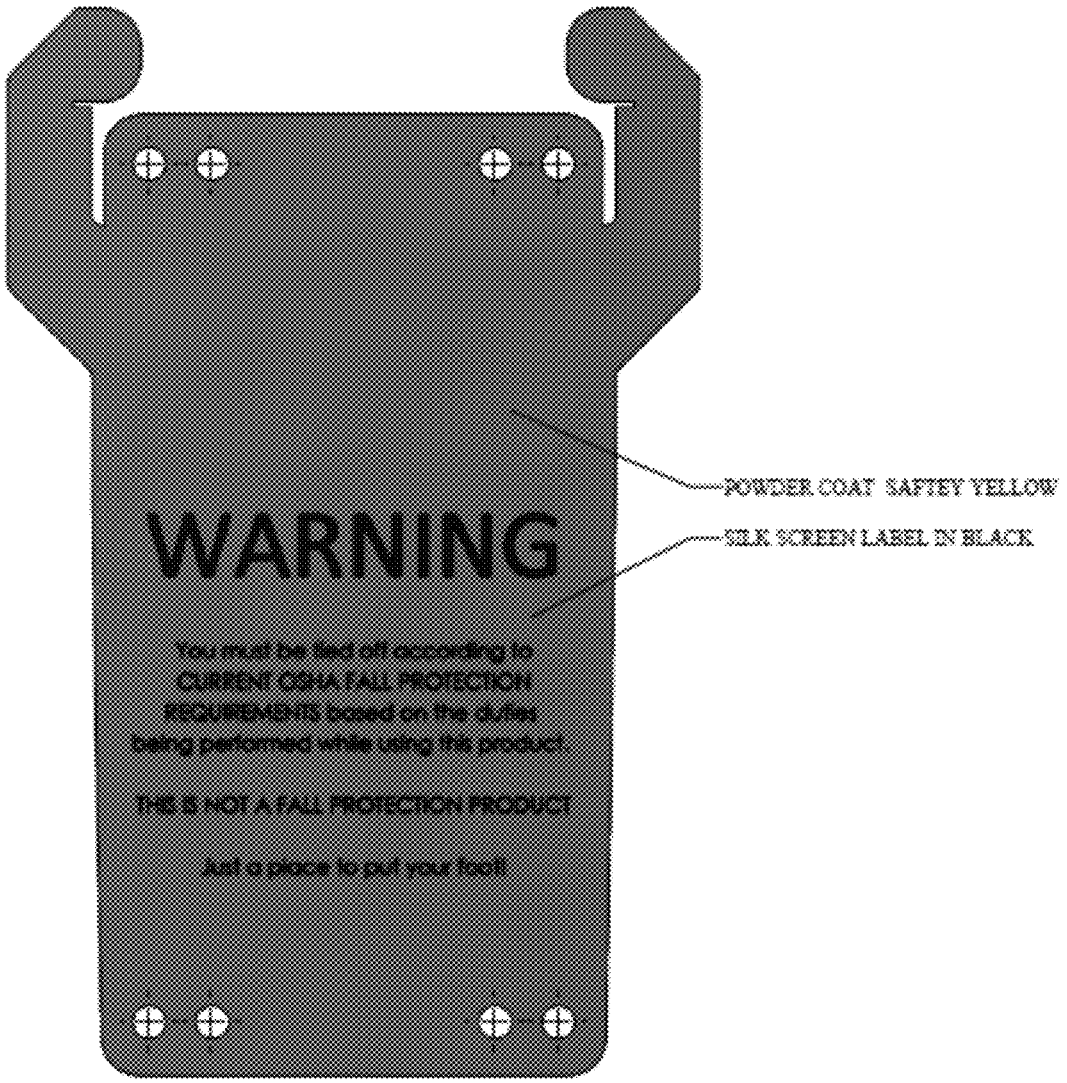
FIG. 9 shows a depiction of a component view of a roof bracket for roof sliding prevention in accordance with an exemplary embodiment of the present disclosure.

FIGS. 7-9 show a depiction of a shoe plate 104 for use in connection with the disclosed specialized roof brackets in accordance with an exemplary embodiment of the present disclosure. FIG. 7, 700 shows an overview of a folded shoe plate component configured to be attached to the specialized roof. FIG. 7, 705, 710, 715, 720 show additional views of the shoe plate showing potential attachment point and attachment faces. For example, the shown configuration connects with the distal and lateral sides of the bracket housing 102. FIGS. 8A and 8B, 800, 805, 810, 815 show additional views of the shoe plate component in an unfolded configuration. FIG. 9, 900 shows a front view of the shoe plate component of the specialized roof bracket and shoe plate for roof sliding prevention.

Figure 10:
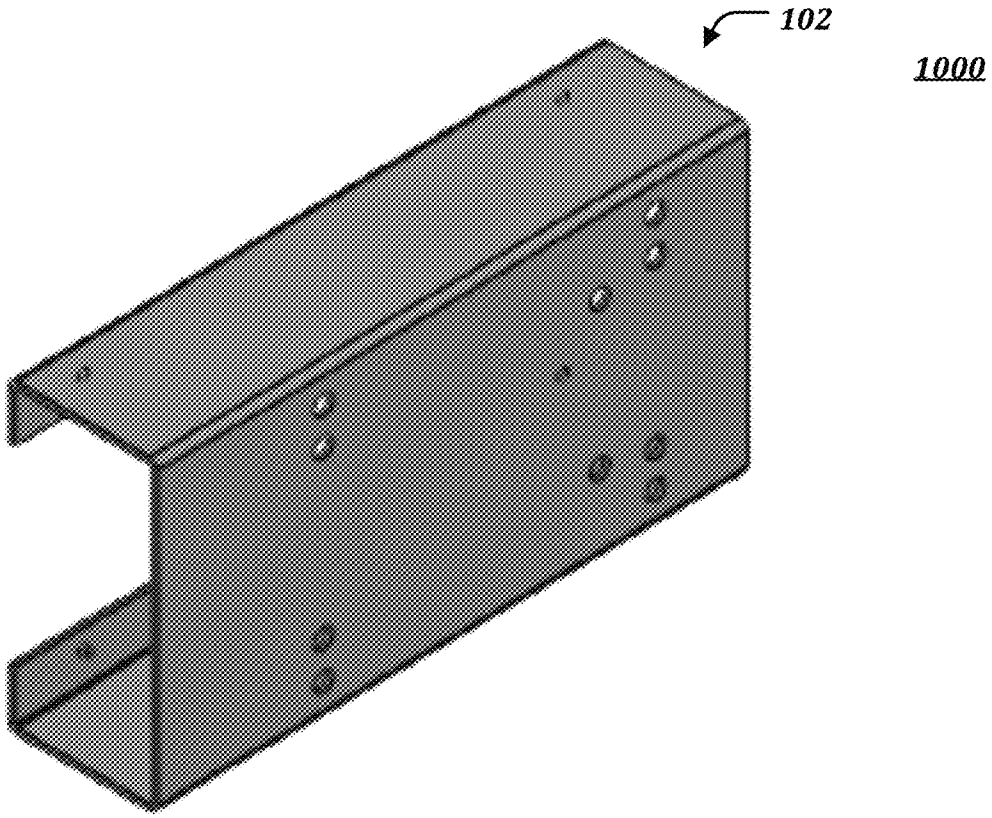
FIG. 10 shows a depiction of a component view of a roof bracket for roof sliding prevention in accordance with an exemplary embodiment of the present disclosure.
Figure 11:
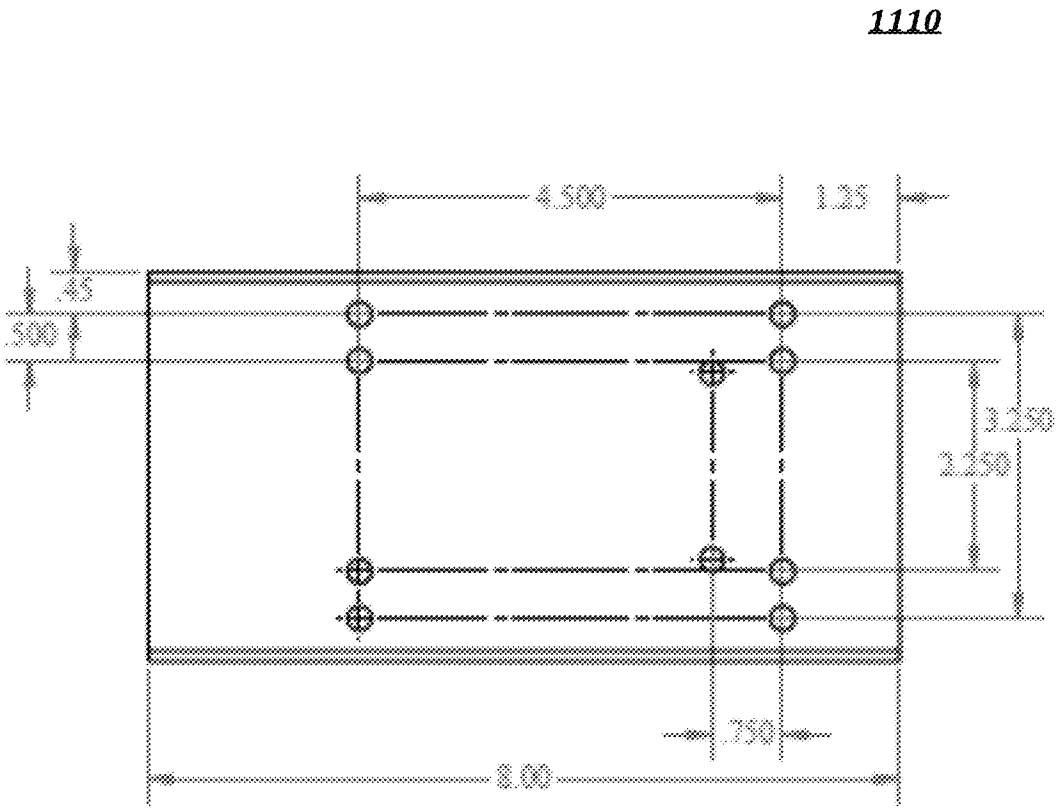
FIG. 11 shows a depiction of a component view of a roof bracket for roof sliding prevention in accordance with an exemplary embodiment of the present disclosure.
Figure 11:
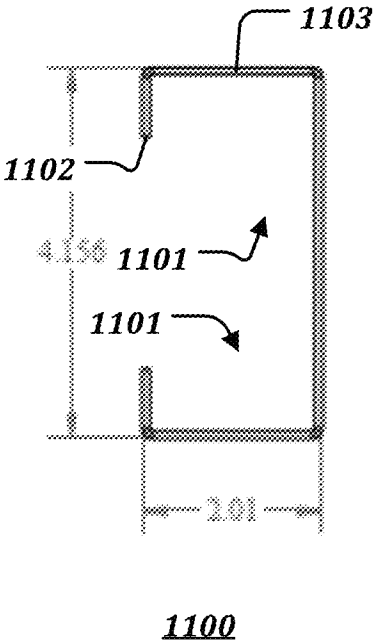
Figure 12:
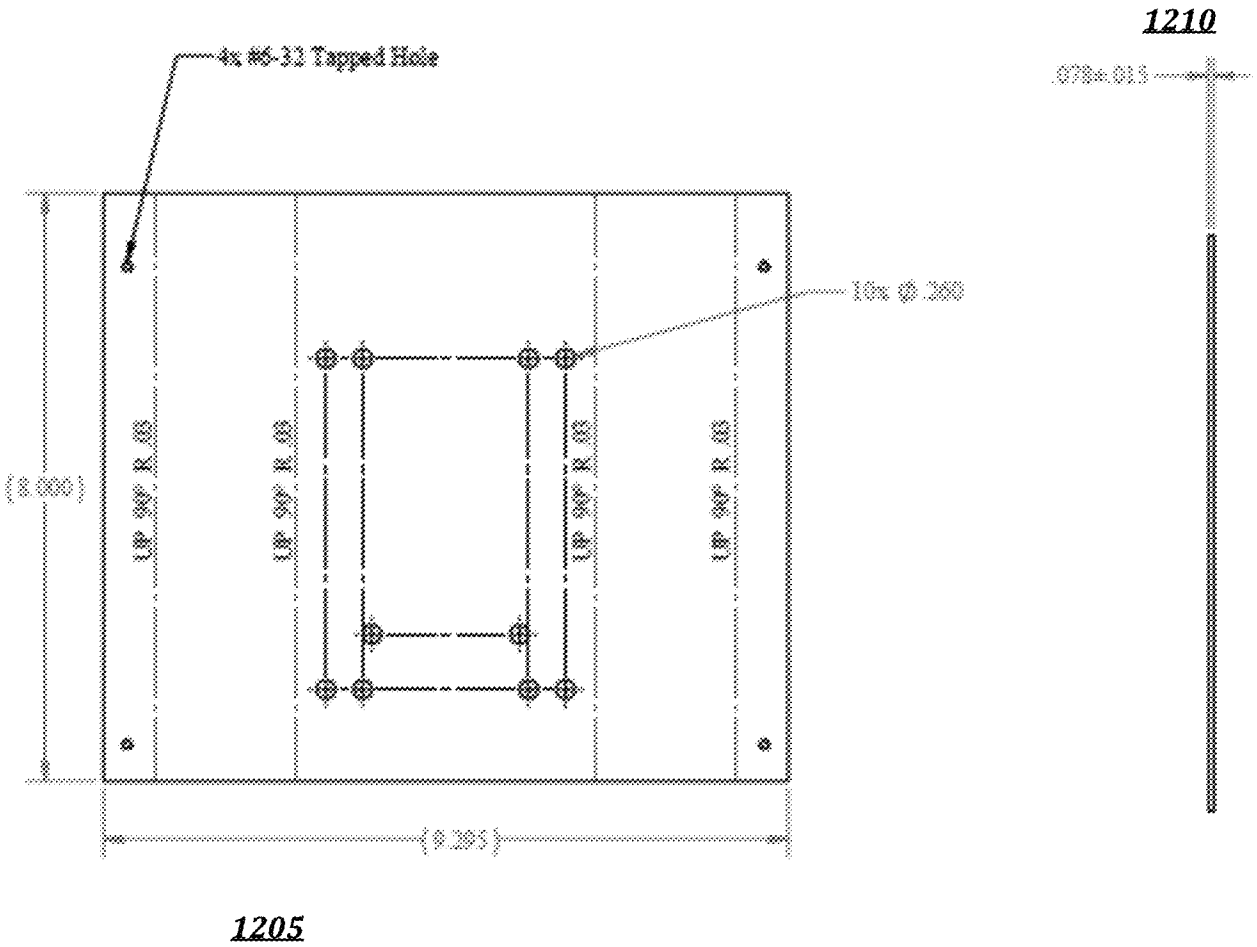
FIG. 12 shows a depiction of a component view of a roof bracket for roof sliding prevention in accordance with an exemplary embodiment of the present disclosure.

FIG. 10-12 show various depictions of housing/bracket 102 of a specialized roof bracket in accordance with an exemplary embodiment of the present disclosure. FIG. 10, 1000 shows an isometric view of the housing component of the specialized roof bracket. FIG. 11, 1100, 1110 show an engineering views of the housing component in a folded view ready for installing bracket components. FIG. 12, 1205, 1210 show an engineering views of the housing component in the unfolded state. As shown, the housing is folded into a C-shape with a slot on the proximal side of the housing. The housing comprises a pair of cam pockets 1101 defined by a first pocket edge 1102 (e.g., seam slot edge) and a lateral side 1103 of the housing. As described herein, each of the cam pockets will contain a plurality of cams.

Figure 13:
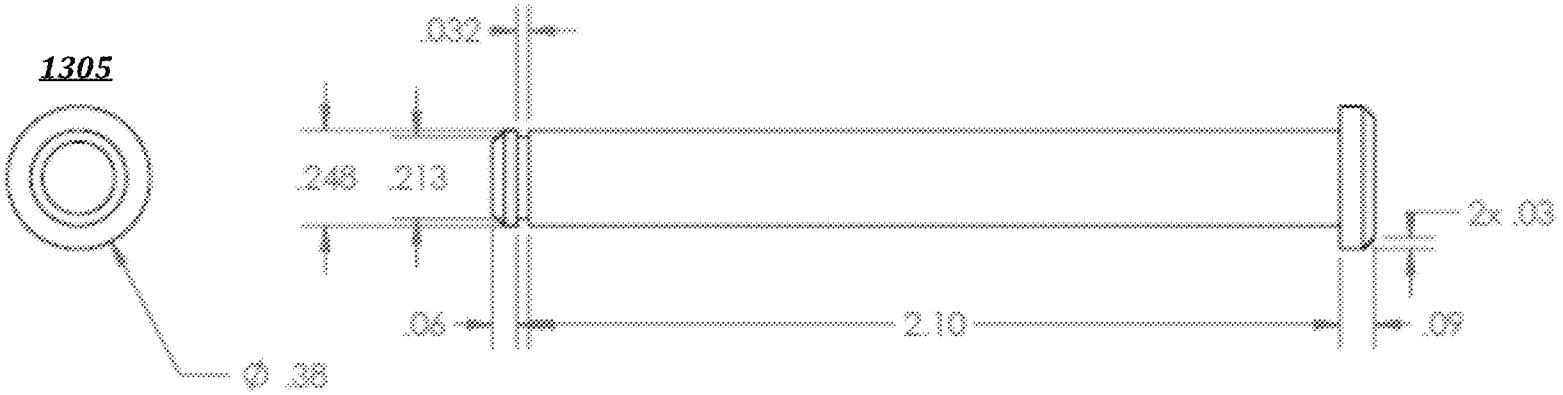
FIG. 13 shows a depiction of a component view of a roof bracket for roof sliding prevention in accordance with an exemplary embodiment of the present disclosure.

FIG. 13 shows a depiction of a pin component of a specialized roof bracket in accordance with an exemplary embodiment of the present disclosure. FIG. 13, 1300, 1305 shows the pin, which is configured to connect to the housing and cam, retaining the cam within the cam pockets, and allowing the cam to rotate about the pin.

The present disclosure relating to a specialized roof bracket and shoe plate for roof sliding prevention mechanical architecture may comprise any number or combination of the any of the following parts and components including but not limited to: a bracket, one or more cams, one or more housing frames, one or more rivets, one or more rubber overmold components fitting the one or more cams, one or more footings, at least one spring, one or more fasteners including but not limited to nuts, bolts, screws, washers, a label, and a foothold component. In further aspects, the parts and components for the specialized roof bracket and shoe plate for roof sliding prevention may include substitute parts or components comparable to the aforementioned components in approximate design and function.

In further aspects, the parts and components may be made from a number of materials including but not limited to: a metal, a plastic, a polymer, rubber, steel, wood, or any combination thereof.

In various aspects, the specialized roof bracket and shoe plate for roof sliding prevention may comprise additional components in a variety of colors or patterns designed for high visibility by the roofer to accommodate ease of use.

Roof Bracket and Apparatus Operation and Methods for Using

Figure 14:
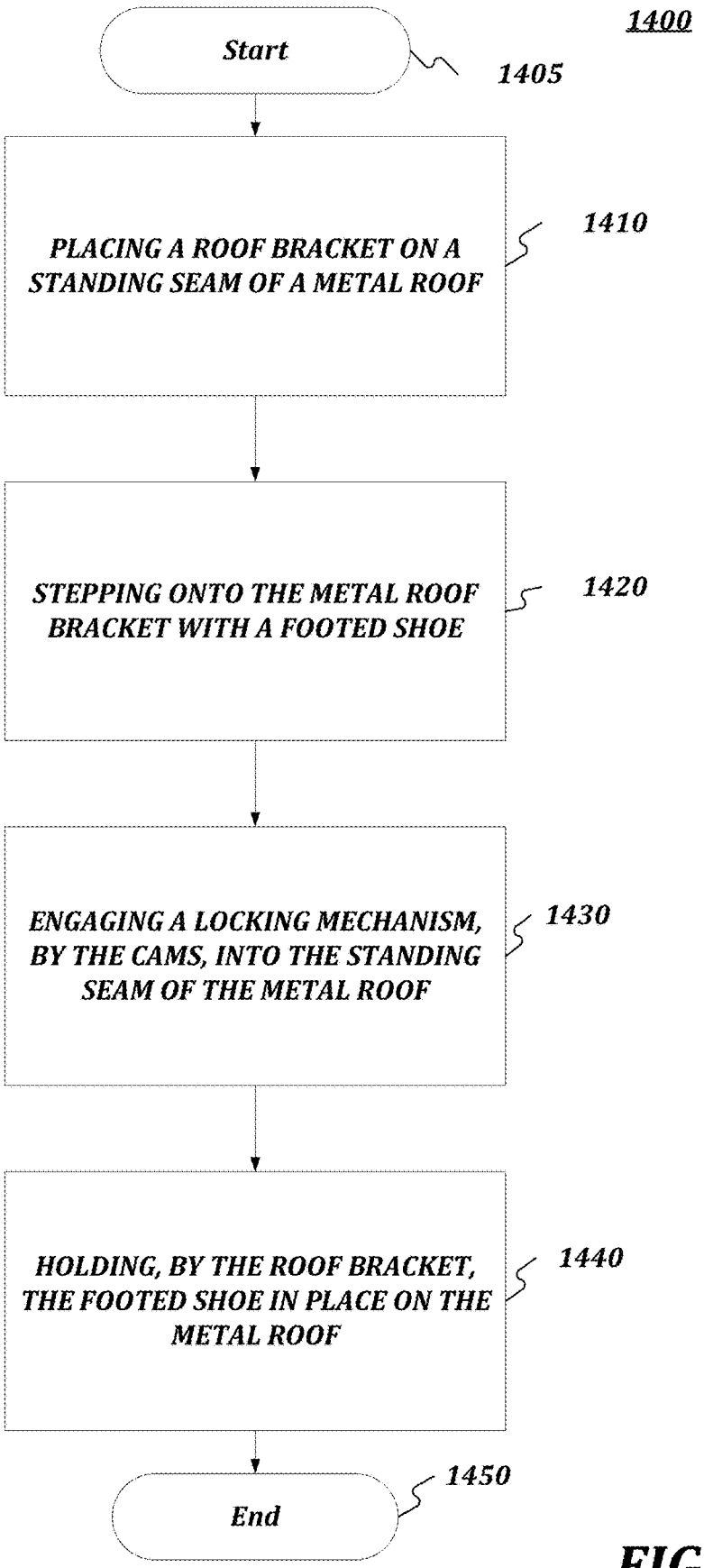
FIG. 14 is a flow chart of a method for providing a roof bracket for roof sliding prevention.

Also disclosed herein are method for using the disclosed roof brackets, platforms, devices, apparatuses, and systems. FIG. 14 is a flow chart setting forth the general stages involved in a method 1400 consistent with an embodiment of the disclosure for providing a stationary foot platform using a disclosed roof bracket or apparatus, i.e., roof bracket 100. Without wishing to be bound by a particular theory, method 1400 may be useful in preventing roof sliding in connection with standing seam metal roofs, for example, when working on standing seam metal roofs. Method 1400 may be implemented using a roof bracket 100 as described in more detail below with respect to FIG. 14. The method 1400 may initiate at block 1405 and terminate at block 1450. Additionally, the method 1400 may repeat, iterate, or loop as needed.

A method 1400 of providing a stationary platform for foot sliding prevention, comprising:

positioning a disclosed roof bracket or apparatus on a standing seam of a roof (1410); stepping onto the roof bracket or apparatus while on the roof (1420); and causing a locking mechanism of the roof bracket or apparatus to securely engage the standing seam of the roof (1430).

In some aspects, the method 1400 can further comprise holding, by the roof bracket, the foot shoe in place on the metal roof. In some aspects, the method 1400 can further comprise repositioning the bracket on the standing seam by sliding the roof bracket upslope on the standing seam, without disengaging. In other aspects, the method 1400 can further comprise stepping on the bracket to securely reengage the standing seam. In various aspects, one, some, or all of the method steps can be performed with the use of tools.

Although method 1400 has been described to be performed by roof bracket 100, it should be understood that various components of roof bracket 100 may be used to perform the various stages of method 1400. Furthermore, in some embodiments, different operations may be performed by different elements or component operatively coupled with roof bracket 100. Similarly, apparatus 200 may be employed in the performance of some or all of the stages in method 1400. Apparatus 200 may also be configured much like roof bracket 100.

Although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein. Ways to implement the stages of method 1400 will be described in greater detail below.

Method 1400 may begin at starting block 1405 and proceed to stage 1410 where roof bracket 100 may be placed or positioned on a standing seam of a metal roof. For example, a roofer may place the roof bracket on the standing seam of the metal roof he is currently working on.

From stage 1410, where roof bracket 100 was placed on a standing seam of a metal roof, method 1400 may advance to stage 1420 where roof bracket 100 may be stepped onto with a footed shoe or an object with sufficient weight may be placed on the bracket. For example, the bracket may be stepped on by a roofer wearing a shoe, or an sufficiently weighted object may be placed on the bracket, and/or a shoe with a wearer's foot in it may apply sufficient weight to the roof bracket.

Once roof bracket 100 is stepped onto with a footed shoe in stage 1420, method 1400 may continue to stage 1430 where roof bracket 100 may engage a locking mechanism, by the cams of the roof bracket, into the standing seam of the metal roof. For example, once the roof bracket may be stepped onto by a roofer, the weight and pressure of the roofer on the bracket causes the bracket to fasten onto the standing seam of the metal roof.

After roof bracket 100 engages a locking mechanism, by the cams of the roof bracket, into the standing seam of the metal roof in stage 1430, method 1400 may proceed to stage 1440 where roof bracket 100 may hold the footed shoe in place on the metal roof. For example, the fastening of the roof bracket to the standing seam in the metal roof may include some type of holding of the footed shoe of the roofer. Once roof bracket 100 holds the footed shoe in place on the metal roof in stage 1440, method 1400 may then end at stage 1450.

The present disclosure, according to further aspects, also provides methods of using the disclosed devices and systems. In one aspect, disclosed herein is a method for a specialized roof bracket, shoe plate, apparatus, device, fastening system, or safety means for roof sliding prevention.

In further aspects, the disclosed roof bracket, apparatus, devices and systems can be used for providing a secure, removable stationary platform, such as for placement of a foot. Without wishing to be bound by a particular theory, it is believed that the availability of the stationary platform on a standing seam provided by the present invention may assist in the prevention of roof sliding. When used properly, the stationary platform can provide a more secure surface to place a foot, as opposed to directly on the seam or on the metal roof portion adjacent to the standing seam.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Further, the disclosed methods' stages may be modified in any manner, including by reordering stages and/or inserting or deleting stages, without departing from the disclosure.

All rights including copyrights in the code included herein are vested in and the property of the Applicant. The Applicant retains and reserves all rights in the descriptions included herein, and grants permission to reproduce the material only in connection with reproduction of the granted patent and for no other purpose.

The present invention includes at least the following aspects: Aspect 1: An apparatus for securing to a standing seam of a panel, the apparatus comprising: a bracket configured to releasably secure to the standing seam of the panel, the bracket comprising: a housing having at least one side comprising a slot configured to allow at least a portion of a standing seam to travel therethrough; a plurality of cams contained within the housing, the plurality of cams rotatably connected to the housing at a first portion of the plurality of the cams; at least one elongated member connected to at least one of the plurality of cams; and at least one tension element connected to the housing and in operable communication with at least one of the plurality of cams, the at least one tension element configured to exert a force effective to maintain at least said cam at a first cam position.

Aspect 2: The apparatus of aspect 1, further comprising a plate connected to at least one side of the housing, said side being opposed to the side comprising the slot; wherein the plate is configured receive a foot, shoe and/or weighted object.

Aspect 3: The apparatus of any preceding aspect, wherein the housing comprises a cam pocket defined by a first pocket edge and a lateral side of the housing, the cam pocket being configured to contain at least one of the plurality of cams.

Aspect 4: The apparatus of any preceding aspect, wherein at least a portion of the plurality of cams is connected to the cam pocket at one or more attachment points.

Aspect 5: The apparatus of any preceding aspect, wherein the plurality of cams are configured to move within the cam pocket.

Aspect 6: The apparatus of any preceding aspect, wherein at least a portion of the plurality of cams is connected to the cam pocket at one or more attachment points.

Aspect 7: The apparatus of any preceding aspect, wherein the housing comprises a plurality of cam pockets defined by a first pocket edge and a lateral side of the housing.

Aspect 8: The apparatus of any preceding aspect, wherein each of the plurality of cam pockets comprises a plurality of cams.

Aspect 9: The apparatus of any preceding aspect, wherein each of the plurality of cams within each cam pocket is connected using an elongated member.

Aspect 10: The apparatus of any preceding aspect, wherein a first group of the plurality of cams is connected using a first elongated member, and a second group of the plurality of cams is connected using a second elongated member.

Aspect 11: The apparatus of any preceding aspect, wherein the elongated member is configured to control movement of any cam connected thereto.

Aspect 12: The apparatus of any preceding aspect, wherein the elongated member is configured to control movement of any cam connected thereto by pulling a first end in a first direction or pushing a second opposed end in the first direction.

Aspect 13: The apparatus of any preceding aspect, wherein the elongated member is configured to control movement of any cam connected thereto by pulling a second member end in a second direction or pushing first member end in the second direction.

Aspect 14: The apparatus of any preceding aspect, wherein at least one connection point of the plurality of cams defines an axis, and wherein the cam is configured to rotate about the axis.

Aspect 15: The apparatus of any preceding aspect, wherein the plurality of cams comprises at least one aperture for receiving a connecting means.

Aspect 16: The apparatus of any preceding aspect, wherein the plurality of cams comprises a plurality of apertures for receiving a connecting means.

Aspect 17: The apparatus of any preceding aspect, wherein the plurality of cams comprises at least one aperture for receiving a connecting means for connecting to a portion of the housing.

Aspect 18: The apparatus of any preceding aspect, wherein the plurality of cams comprises at least one aperture for receiving a connecting means for connecting to an elongated member.

Aspect 19: The apparatus of any preceding aspect, wherein the plurality of cams comprises a first aperture for receiving a connecting or attachment means for connecting to a portion of the housing, and a second aperture for receiving a connecting means for connecting to a portion of the elongated member.

Aspect 20: The apparatus of any preceding aspect, wherein the housing comprises at least one aperture for receiving a connecting means.

Aspect 21: The apparatus of any preceding aspect, wherein the housing comprises a plurality of apertures for receiving a connecting means.

Aspect 22: The apparatus of any preceding aspect, wherein the housing comprises at least one aperture for receiving a connecting means for connecting to a portion of one or more of the plurality of cams.

Aspect 23: The apparatus of any preceding aspect, wherein the housing comprises at least one aperture for receiving a connecting means for connecting to a shoe plate.

Aspect 24: The apparatus of any preceding aspect, wherein at least one connection point of the plurality of cams defines an axis, and wherein the cam is configured to rotate from greater than 0 degrees to about 90 degrees about the axis.

Aspect 25: The apparatus of any preceding aspect, wherein the plurality of cams is configured to rotate from a first cam position to a second cam position.

Aspect 26: The apparatus of any preceding aspect, wherein the first cam position corresponds to a cam position effective to allow at least a portion of the standing seam to move within the slot of the housing.

Aspect 27: The apparatus of any preceding aspect, wherein the second cam position corresponds to a cam position effective to securely grip at least a portion of the standing seam to prevent movement within the slot of the housing.

Aspect 28: The apparatus of any preceding aspect, wherein at least one cam position corresponds to a gripping operation mode of the apparatus.

Aspect 29: The apparatus of any preceding aspect, wherein the first cam position corresponds to a passing operation mode of the apparatus wherein the standing seam is positioned with the housing slot.

Aspect 30: The apparatus of any preceding aspect, wherein the second cam position corresponds to a gripping operation mode of the apparatus wherein the standing seam is secured within the housing.

Aspect 31: The apparatus of any preceding aspect, wherein at least one cam position is configured to cause an effective portion of a gripping edge of the cam to secure against a portion of the standing seam to prevent movement within the housing.

Aspect 32: The apparatus of any preceding aspect, wherein at least a portion of the at least one cam in a first cam position is configured to extend into the slot in a first predetermined distance.

Aspect 33: The apparatus of any preceding aspect, wherein at least a portion of the at least one cam in a second cam position is configured to extend into the slot in a second predetermined distance, greater than the first predetermined distance.

Aspect 34: The apparatus of any preceding aspect, wherein the gripping edge of the cam is configured to extend beyond an outer edge of the cam pocket.

Aspect 35: The apparatus of any preceding aspect, wherein the cam is configured to move from a second cam position to a first cam position where a portion of the cam is retracted into a cam pocket upon a standing seam being removed from the slot.

Aspect 36: The apparatus of any preceding aspect, wherein at least one cam is configured to return from the second cam position to the first cam position upon the standing seam exiting the slot.

Aspect 37: The apparatus of any preceding aspect, wherein at least one cam is angled in the housing using the at least one tension element to allow for cam movement upon insertion of a standing seam.

Aspect 38: The apparatus of any preceding aspect, wherein a first group of a plurality of cams is connected to a distal side of the housing using the at least one tension element.

Aspect 39: The apparatus of any preceding aspect, wherein the elongated member is configured to retract any cam connected thereto from a second cam position to a first cam position upon a standing seam being removed from the slot.

Aspect 40: The apparatus of any preceding aspect, further comprising at least one cam spacer.

Aspect 41: The apparatus of any preceding aspect, wherein the at least one cam spacer is disposed between a distal side of a cam and an inner surface of the housing.

Aspect 42: A method, comprising: placing a roof bracket on a standing seam of a roof, the roof bracket configured to releasably secure to the standing seam of the roof; stepping onto the roof bracket; and causing a locking mechanism of the roof bracket to secure the standing seam.

Aspect 43: The method of aspect 42, wherein the roof bracket comprises the apparatus of any preceding Aspect.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior disclosure. Further, the dates of publication provided herein can be different from the actual publication dates, which can require independent confirmation.

The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

The following is claimed:

1. A bracket configured to releasably secure to a standing seam of a panel, the bracket comprising:

a housing having a slot configured to allow at least a portion of the standing seam to travel therethrough;

a plurality of cams contained within the housing, each cam, of the plurality of cams, being rotatably connected to the housing at a first portion of the cam; and at least one tension element connected to the housing and configured to exert a force effective to maintain at least one cam of the plurality of cams at a first cam position;

wherein each cam, of the plurality of cams, is configured to rotate from the first cam position to a second cam position, the first cam position corresponding to a cam position effective to allow at least a portion of the standing seam to move within the slot of the housing, and the second cam position corresponding to a cam position effective to securely grip at least a portion of the standing seam to prevent movement within the slot of the housing; and wherein said at least one cam of the plurality of cams is configured to overcome the force to rotate from the first cam position to the second cam position.

2. The bracket of claim 1, wherein the at least one tension element is configured to exert a force effective to maintain each of the plurality of cams at the first cam position, and wherein each of the plurality of cam are configured to overcome the force to rotate from the first cam position to the second cam position.

3. The bracket of claim 1, wherein at least a portion of each cam of the plurality of cams, when in the first cam position, is configured to extend into the slot by a first predetermined distance effective to allow the standing seam to be movably positioned within the slot of the housing; and wherein at least a portion of each cam, when in the second cam position, is configured to extend into the slot by a second predetermined distance effective to fixedly secure at least a portion of the standing seam positioned within the slot of the housing.

4. The bracket of claim 1, wherein the plurality of cams are configured to move from the second cam position into the first cam position upon the standing seam being removed from within the slot of the housing.

5. The bracket of claim 1, wherein at least one cam of the plurality of cams is angled in the housing using the at least one tension element to allow for cam movement upon insertion of the standing seam.

6. The bracket of claim 1, wherein a first group of the plurality of cams is connected to a distal side of the housing using the at least one tension element; and wherein the at least one tension element is configured to retract any cam connected thereto from the second cam position to the first cam position upon the standing seam being removed from the slot.

7. A bracket configured to releasably secure to a standing seam of a panel, the bracket comprising:

a housing having a slot configured to allow at least a portion of the standing seam to travel therethrough; and a plurality of cams contained within the housing, each cam, of the plurality of cams, being rotatably connected to the housing at a first portion of the cam;

wherein each cam, of the plurality of cams, is configured to rotate from a first cam position to a second cam position, the first cam position corresponding to a cam position effective to allow at least a portion of the standing seam to move within the slot of the housing, and the second cam position corresponding to a cam position effective to securely grip at least a portion of the standing seam to prevent movement within the slot of the housing; and wherein rotation from the first cam position to the second cam position comprises a rotation from greater than 0 degrees to about 90 degrees about an axis of rotation.

8. The bracket of claim 7, further comprising a tension element connected to the housing and configured to exert a force effective to maintain at least one cam of the plurality of cams at the first cam position.

9. The bracket of claim 8, further comprising a plate connected to an exterior of the housing, substantially opposed to the slot; and wherein the plate is configured receive a foot or shoe.

10. The bracket of claim 8, wherein the housing comprises a plurality of cam pockets defined by a first pocket edge and a lateral side of the housing, each cam pocket being configured to contain at least one of the plurality of cams.

11. The bracket of claim 10, wherein each cam pocket contains a plurality of cams, and wherein at least the first portion of each of the plurality of cams is connected to the cam pocket at one or more attachment points; the plurality of cams being configured to move within the cam pocket.

12. The bracket of claim 11, wherein each of the plurality of cams within each cam pocket is connected using an elongated member configured to control movement of any cam connected thereto.

13. The bracket of claim 12, wherein a first group of the plurality of cams is connected using a first elongated member, and a second group of the plurality of cams is connected using a second elongated member.

14. The bracket of claim 12, wherein the elongated member is configured to control movement of the plurality of cams connected thereto by pulling a first end of the elongated member in a first direction or pushing a second end of the elongated member in the first direction.

15. The bracket of claim 12, wherein the elongated member is configured to control movement of the plurality of cams connected thereto by pulling a second end of the elongated member in a second direction or pushing first end of the elongated member in the second direction.

16. A bracket configured to releasably secure to a standing seam of a panel, the bracket comprising:

a housing having a slot configured to allow at least a portion of the standing seam to travel therethrough;

a plurality of cams contained within the housing, each cam, of the plurality of cams, being rotatably connected to the housing at a first portion of the cam; and a tension element connected to the housing and configured to exert a force effective to maintain at least one cam at a first cam position;

wherein at least one cam, of the plurality of cams, is configured to rotate from a first cam position to a second cam position, the first cam position corresponding to a cam position effective to allow at least a portion of the standing seam to move within the slot of the housing, and the second cam position corresponding to a cam position effective to securely grip at least a portion of the standing seam to prevent movement within the slot of the housing.

17. The bracket of claim 16, wherein at least a portion of the at least one cam, of the plurality of cams, when in the first cam position, is configured to extend into the slot by a first predetermined distance effective to allow the standing seam to be movably positioned with the slot of the housing; and wherein at least a portion of the at least one cam, when in the second cam position, is configured to extend into the slot by a second predetermined distance greater than the first predetermined distance, wherein the at least one cam extending into the slot by the second distance is effective to fixedly secure at least a portion of the standing seam within the housing.

18. The bracket of claim 16, further comprising a plate connected to an exterior of the housing, substantially opposed to the slot; and wherein the plate is configured receive a foot or shoe.

19. The bracket of claim 16, wherein the at least one cam overcomes the force to rotate from the first cam position to the second cam position.

20. The bracket of claim 19, wherein rotation of the at least one cam from the first cam position to the second cam position comprises a rotation from greater than 0 degrees to about 90 degrees about an axis of rotation.

* * * * *